United States Patent [19]

Rock et al.

[11] 4,176,424

[45] Dec. 4, 1979

[54] HINGE CASING

[75] Inventors: Erich Röck, Höchst; Bernhard Mages, Dornbirn, both of Austria

[73] Assignee: Julius Blum Gesellschaft m.b.H., Höchst, Austria

[21] Appl. No.: 873,536

[22] Filed: Jan. 30, 1978

[30] Foreign Application Priority Data

Feb. 9, 1977 [AT] Austria ..... 829/77

[51] Int. Cl.[2] ..... E05D 11/00

[52] U.S. Cl. ..... 16/148; 16/159; 16/163; 403/23

[58] Field of Search ..... 16/148, 159, 163, 164, 16/165, 166, 2, 108; 403/23

[56] References Cited

U.S. PATENT DOCUMENTS

| | | | |
|---|---|---|---|
| 3,541,633 | 11/1970 | Heinze | 16/164 |
| 3,958,300 | 5/1976 | Tanaka | 16/2 |
| 4,021,881 | 5/1977 | Läutenschlager | 16/159 |
| 4,085,481 | 4/1978 | Läutenschlager | 16/159 |

FOREIGN PATENT DOCUMENTS

| | | | |
|---|---|---|---|
| 2143455 | 3/1972 | Fed. Rep. of Germany | 16/148 |
| 2457022 | 6/1976 | Fed. Rep. of Germany | 16/159 |
| 2520263 | 11/1976 | Fed. Rep. of Germany | 16/148 |

*Primary Examiner*—Werner H. Schroeder
*Assistant Examiner*—Moshe I. Cohen
*Attorney, Agent, or Firm*—Wenderoth, Lind & Ponack

[57] ABSTRACT

A hinge includes a hinge casing made of plastic material and a cover plate made of metal which is securable on the hinge casing to cover the top of the casing such that when the latter is mounted in a furniture door there is given the impression that the casing is made of metal.

2 Claims, 7 Drawing Figures

HINGE CASING

BACKGROUND OF THE INVENTION

The invention relates to a hinge casing comprising a dowel member or part of a plastic material and a separate cover plate of metal which can be mounted on and fixed to the dowel part, the dowel part preferably having clamping ribs located on its peripheral surface and bores for mounting hinge links by means of hinge axles, such hinge links being positioned in a recess of the dowel part when the hinge is closed.

DESCRIPTION OF THE PRIOR ART

Such hinge casings are widely used in modern furniture production.

Initially, hinge casings made of metal, e.g. of a pressure casting, or made of plastics were used.

Hinge casings made of metal are more resistant to wear and their working life is usually longer than the working life of hinge casings made of plastics.

On the other hand, hinge casings made of plastics are appreciated due to their low price and due to the fact that the resilience of the material used creates a spreading effect of the dowel part with respect to the walls of the bores, so that the hinge casing need not always be anchored by fastening screws which can easily be torn out of the wooden plate of the furniture.

A disadvantage of hinge casings made of plastics is their outward appearance. Most people regard hinge casings made of plastics as being of inferior quality than hinge casings made of metal.

It has been shown, however, that a longer working life of the hinge can be achieved by mounting the hinge links in a plastic material than by mounting them in a metal casing. It must be admitted on the other hand that the visible surface of a plastic casing can be damaged more easily by scratches or the like than in the case of a metal casing.

Known hinge casings consisting of a plastic dowel part and of a metal cover plate have the disadvantage that no optimum fastening of the cover plate can be achieved and that it can, therefore, easily be separated from the dowel part when the door is closed with a bang.

SUMMARY OF THE INVENTION

It is the object of the invention to create a hinge casing of the above-mentioned kind in which the cover plate can be locked absolutely secure to the dowel part.

According to the invention this is achieved by providing two L-shaped grooves located at two opposite walls of a recess of the dowel part, one arm of each groove extending to the upper edge of the respective wall, whereby projections or the like formed on inwardly bent flanges of the cover plate can be inserted into the grooves, and by providing one end of each of the flanges of the cover plate with a horizontal groove into which a hinge axle projects in the assembled position.

It is advantageously provided that the hinge axles are made of plastics, as such an embodiment provides particular protection of the hub of the hinge links which are made of metal.

In the following an embodiment of the invention will be described in more detail with reference to the figures of the attached drawings.

DESCRIPTION OF THE PREFERRED EMBODIMENTS

Figure 2:
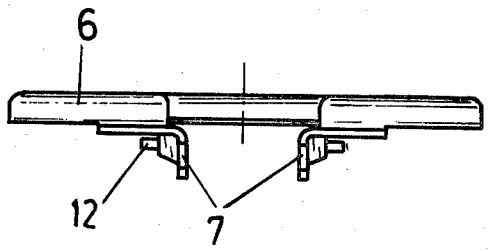
FIG. 2 shows a view in the direction of arrow A of FIG. 1.

The hinge casing according to the invention has a dowel member or part 1 which is injection-moulded of plastic and produced in a conventional way, whereby certain demands with regard to the quality of the visible top surface might be disregarded. The dowel part 1 has clamping ribs 2 which press into the wall of the bore of a piece of furniture into which the dowel part is inserted, as well as locking dowels 3 for additional fastening in the piece of furniture, e.g. a furniture door. The locking dowels 3 also have clamping ribs 2.

The dowel part 1 is, moreover, provided with bearing bores 4 in which the hinge axles 5 are positioned in the assembled position.

As its top surface the dowel part 1 has a metal cover plate 6 totally covering the top surface of the dowel part 1.

The cover plate 6 has two flanges 7 which are bent to project into a recess 8 of the dowel part 1, recess 8 housing the hinge links 9 when the hinge is closed, and flanges 7 resting against the side walls 10 in the recess 8.

Figure 1:
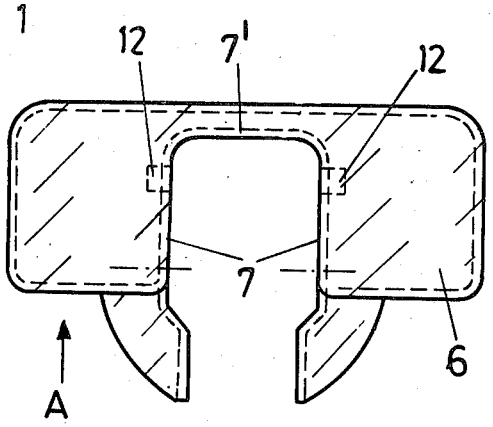
FIG. 1 shows a top view of a cover plate according to the invention.

The flanges 7 can be two separate flanges or, as can be seen in FIG. 1, they can be connected by a middle flange 7' so that they entirely embrace the recess 8.

Figure 3:
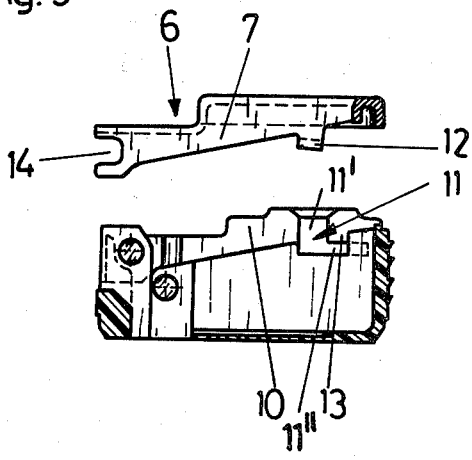
FIG. 3 shows a section through a hinge casing according to the invention, the cover plate and the dowel part being separated from each other.
Figure 4:
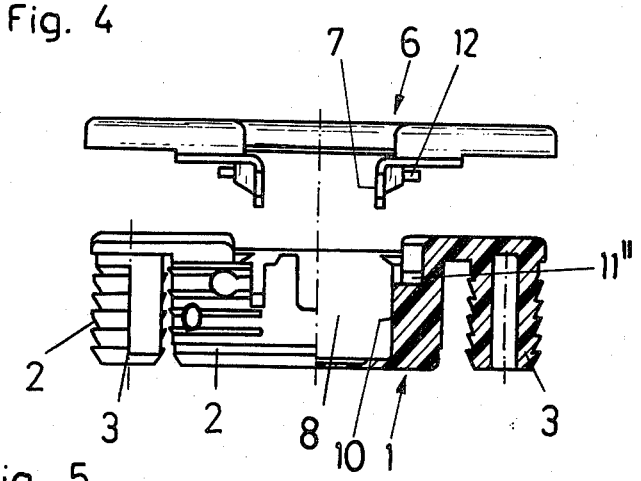
FIG. 4 shows a side view, partially in section, of a hinge casing according to the invention, the dowel part and the cover plate also being drawn apart.

The side walls 10 of the recess 8 of the dowel part 1 have, as can particularly be seen in FIG. 3, L-shaped grooves 11, one arm 11' of the groove 11 being broader than the other arm 11" of the groove 11 and being open towards the upper edge of the wall 10.

Projections 12 are formed on the flanges 7 and are insertable into the grooves 11, as can particularly be seen in FIG. 3, and projections 12 are retained behind projections 13 formed by the grooves 11 when the flanges are inserted.

Thus the cover plate 6 is anchored to one side or end of the dowel part 1.

The flanges 7 of the cover plate 6 also have recesses 14 on the other end. When the hinge is assembled, the hinge axles 5 of the inner hinge link 9 project into recesses 14.

Figure 5:
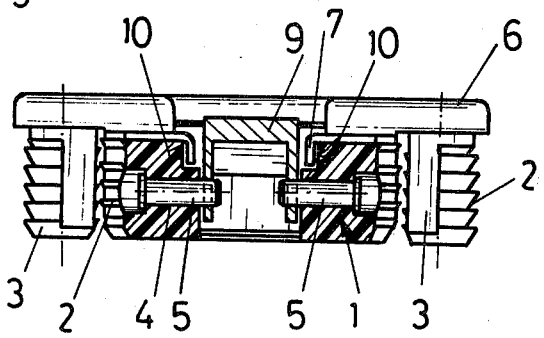
FIG. 5 shows a side view, partially in section, of a dowel part with the cover plate attached.
Figure 6:
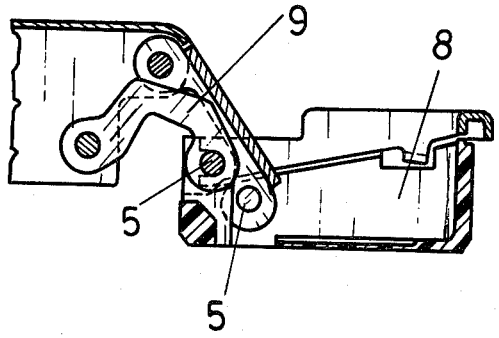
FIG. 6 shows a section analogous to FIG. 3, the cover plate being attached to the dowel part and the hinge links and the hinge arm also being shown.
Figure 7:
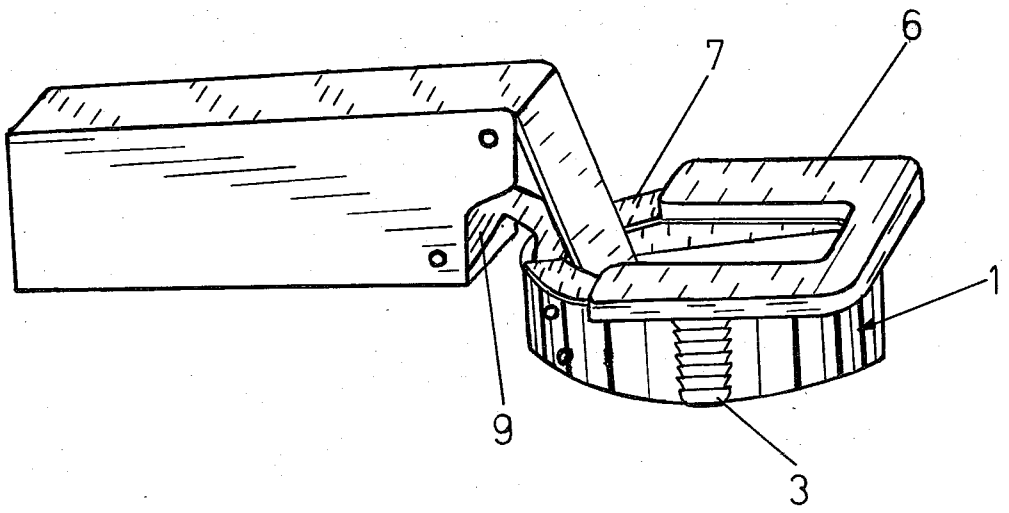
FIG. 7 shows a three-dimensional view of a hinge with a hinge casing comprising a dowel part and a cover plate.

As can be seen in FIG. 5, the embodiment provides two hinge axles 5 made of plastics in order to guarantee particularly good bearing means for the metal hinge links 9.

In this embodiment the cover plate 6 made of metal is absolutely locked to the dowel part 1 in a manner such that additional fastening means, such as screws, rivets or the like, are not necessary. Only the shape of the dowel part 1 has to be altered (groove 11), and apart from the normal hinge parts (hinge axle 5) no special fastening means are necessary.

The cover plate 6 can, if desired, also be taken off the dowel part 1 and be exchanged. For this, only the hinge axles 5 have to be pulled out from the dowel part 1.

We claim:

1. A hinge casing adapted to be recessed in an article of furniture and to be connected to hinge links of a hinge, said hinge casing comprising:

an integral single dowel member formed of a plastic material, said dowel member adapted to be inserted into a bore in an article of furniture, said dowel member having an exterior surface having clamping ribs, said dowel member having formed therein a recess defined by a pair of spaced internal walls, each said wall having therein an L-shaped groove having one arm opening onto the outer edge of the respective said wall;

hinge axle means, extending into said dowel member in a direction substantially transverse to said walls, for connecting hinge links of a hinge to said dowel member, whereby when the hinge is closed the hinge links are positioned in said recess;

an integral single cover member formed of a metal material, said cover member including a pair of spaced inwardly extending flanges, each said flange having adjacent a first end thereof a projection, and each said flange having formed in a second end thereof an end recess; and said cover member being mounted on said dowel member with said flanges projecting into said recess and contacting said outer edges of respective said walls, with said projections extending into respective said grooves, and with said hinge axle means fitting in said end recesses, with said dowel member and said cover member being free of any other interconnecting structure.

2. A hinge casing as claimed in claim 1, wherein said hinge axle means comprises hinge axles formed of a plastic material.

* * * * *